US005902221A

United States Patent [19]

Engels

[11] Patent Number: 5,902,221

[45] Date of Patent: May 11, 1999

[54] APPARATUS FOR THE STAMPING OF WASTE FROM A STACK OF PLASTIC BAGS

[75] Inventor: Rudolf Engels, Siegburg, Germany

[73] Assignee: Lemo Maschinenbau GmbH, Niederkassel-Mondorf, Germany

[21] Appl. No.: 08/872,838

[22] Filed: Jun. 11, 1997

[30] Foreign Application Priority Data

Jun. 15, 1996 [DE] Germany ..... 196 23 330

[51] Int. Cl.[6] ..... B31B 1/86

[52] U.S. Cl. ..... 493/226; 493/227; 493/373; 493/926

[58] Field of Search ..... 83/112, 152, 155.1, 83/167; 493/373, 281, 287, 226, 227, 926

[56] References Cited

U.S. PATENT DOCUMENTS

| | | | |
|---|---|---|---|
| 4,249,438 | 2/1981 | Kelley | 83/167 |
| 4,386,924 | 6/1983 | Crawford et al. | 493/926 |
| 4,883,450 | 11/1989 | Benoit | 493/926 |
| 4,906,228 | 3/1990 | Reifenhauser et al. | 493/926 |
| 4,914,996 | 4/1990 | Lavorel | 83/152 |
| 5,087,236 | 2/1992 | Morimoto | 493/373 |
| 5,480,099 | 1/1996 | Bunton | 241/119 |
| 5,630,779 | 5/1997 | Glod et al. | 493/926 |
| 5,732,609 | 3/1998 | Marschke | 83/167 |

FOREIGN PATENT DOCUMENTS

| | | |
|---|---|---|
| 22 33 408 | 10/1973 | Germany . |
| 34 32 496 | 4/1985 | Germany . |
| 9116425 U | 10/1992 | Germany . |

*Primary Examiner*—James F. Coan
*Assistant Examiner*—Gene Kim
*Attorney, Agent, or Firm*—Herbert Dubno

[57] ABSTRACT

A method of and an apparatus for punching a waste bundle from a stack of bags, especially to form a peripherally-closed hole in the stack as in the production of so-called tie bags, wherein with the lowering of the upper press tool, the waste bundle is cut from the stack of bags lying in a cutting plane pressed into a recess below the cutting plane. The stack is then laterally removed in the plane and an ejector below the plane lifts the waste bundle back into the plane so that it can be swept laterally onto a chute which carries off the waste.

11 Claims, 6 Drawing Sheets

APPARATUS FOR THE STAMPING OF WASTE FROM A STACK OF PLASTIC BAGS

SPECIFICATION

1. Field of the Invention

My present invention relates to an apparatus for stamping and removing a block of waste from a stack of plastic bags which are joined together to form a stack or a pad of such bags, especially in the course of manufacturing tie bags and the like. More particularly the invention relates to the stamping out, from such a stack, of a block of waste material between the ties or handles of such bags. The invention especially relates to a stamping unit having a raisable and lowerable stamping tool in the form of a cutting plate and a blade which cooperates therewith to separate the block of waste from the stack and to the means for carrying off the pad of waste.

2. Background of the Invention

In the fabrication of bags from synthetic resin or plastic foil or film, it is common to stack the bags as they are formed and to secure the stacked bags together in a coherent stack or pad. It is desirable in addition, to cut out a block of waste from such a stack, usually between the handles or ties, thereby separating the handles or ties from one another. The block of waste is normally cut out in the region of the filling openings of the bags. The punching or stamping of the block of waste may separate the latter from the stack of bags all around the perimeter of the block and, if desired, a portion can be maintained between the handle for supporting the stack of bags on a holder when, for example, the bags are opened one at a time for filling, e.g. in a supermarket or the like. The handles which are formed may be loops through which the hand of a user can grip the bag, especially in the case of so-called shirt bags, or can be ties which, when the bag is filled, can be knotted together to close the bag. In other words the removal of the block of waste can leave free ends of the handles or ties or a web of the plastic foil can connect the ends of the ties so that the bag can be later torn away from this web.

One of the problems encountered in the past has been the effective full peripheral cutting of the block of waste from the stack of plastic foil bags. The other problem has been the removal of the block once it has been separated from the stack. The removal of the waste block can be effected by providing a cutting plate on a movable punching tool which can cooperate with a cutting blade, the latter being located below the cutting plate and having an opening through which the waste block can fall. The waste block can be collected on a belt and carried off. A blade having an opening through which the waste block can be discharged either has stability problems or is relatively expensive to construct to minimize such instability. Access to the cutting blade is limited by its orientation below the cutting plate so that replacement of the cutting blade is relatively time-consuming, labor intensive and costly.

Furthermore, the removal of the waste block can pose a problem, especially when more than several bags are stacked. In those cases, the waste block can often hang up in the opening within the blade. As a consequence, the bag fabrication line frequently must be brought to standstill.

It is known to provide carrying bags utilizing a so-called full stamping technique, especially for the production of shirt bags in which a U-shaped waste bag is stamped out between the handle of the bag. In the production of carrying bags with a full stamping, the removal of the waste block can be comparatively simple since the waste block easily can be removed from an open side of the stamping system. For example, the stack of bags can be moved to one side while the waste block is shifted to the opposite side and delivered to a transport belt.

OBJECTS OF THE INVENTION

It is, therefore, the principal object of the present invention to provide an improved apparatus for the punching or stamping of a waste block from a stack of carrying bags of a plastic or synthetic resin material which can be carried out in the course of bag manufacture, particularly for handle or tie type bags, whereby comparatively simple means can be utilized to effect the separation of the waste pad from the stack and to carry off the waste block in an efficient manner.

Another object of the invention is to provide an apparatus for the punching of waste blocks from stacks of plastic bags which facilitates maintenance and replacement of the cutting blades and wherein the apparatus as a whole can be fabricated at low cost.

Still another object of this invention is to provide a highly reliable apparatus for punching or stamping waste blocks from stacks of plastic bags in a highly reliable and effective manner.

SUMMARY OF THE INVENTION

These objects and others which will become apparent hereinafter are attained, in accordance with the invention, in an apparatus for the production of bags with the peripheral closed stamping of waste blocks from stacks of bags, especially during production of tie bags in which the cutting blade is located above the stack of bags and above the cutting plate, the stamped-out waste block is collected in a recess or chamber below the stamping plane in a stamping plate, a pusher element can rise in this recess to displace the punched-out block at least into the stamping plane and means is provided which is movable in the stamping plane for entraining the waste plug out of the punching region. With the system of the invention, a device for punching out and removing the waste block is combined with the means for removing it, thereby resulting in a considerable saving in time in the use of the apparatus. The punched-out waste block can reliably be pressed by the pusher element into the recess of the cutting plate and held therein until the stack of bags is carried off so that the subsequent entrainment of the waste blocks can be effected in a corresponding way by the displacement device.

More particularly, an apparatus for punching a waste block or bundle from a stack of bags can comprise:

a machine frame;

a support on the machine frame;

a cutting plate on the support formed with an upwardly open recess;

a punching member above the cutting plate and movable up and down on the machine frame;

a cutting blade on the punching member aligned with the recess for cutting a waste bundle from a stack of bags overlying the cutting plate and lying in the punching plane;

a pressing element on the punching member for pressing the waste bundle into the recess;

stack-transfer means movable parallel to the punching plane for engagement with a stack of bags, drawing the stack onto the cutting plate, and displacing a stack of bags on the cutting plate after punching away from the cutting plate;

ejection means displaceable in the recess for lifting the waste bundle into the plane; and means on the stack-transfer means engageable with the waste bundle in the plane for displacing the waste bundle away from the cutting plate.

More particularly, in the process of the invention the stamping and removal of a waste bundle or block from a peripherally closed punching displaces the waste bundle or block below the level at which the bags are supported and, upon separation of the stamping or punching members and removal of the punched stack, e.g. of tie bags in which the opposing ties are bridged by a remaining portion of the stack, the stamped-out waste bundle is lifted again into the stamping plane and laterally displaced therefrom, preferably by the mechanism which reaches past the punch to draw another stack of the synthetic resin foil bags into position.

An important feature of the apparatus of the invention is that one and the same apparatus can be used also for punching out of a waste bundle which is not peripherally closed, i.e. extends to the edge of the stack, i.e. of so-called shirt bags, as is used for the production of bags by the punching of the bundle from a peripherally-closed space, i.e. so-called tie bags in which the ties are bridged by a remaining portion of the bag stack. In this case, the cutting plate merely need be provided with a filler piece when peripherally-closed punching is to be effected whereas, for peripherally open punching as in the earlier-described case in with a filler piece can be removed. In other words one and the same apparatus can be used in the course of producing tie bags in which the ties are joined by the bridge piece as can be used in the course of producing shirt bags where the two handles of the bag are not bridged and the handles delimit an open space from which the waste bundle has been punched.

Of course, the invention need not be used exclusively for the stamping of waste bundles from tie bags or shirt bags but can be used whenever the stamping of grip openings, hanger openings or the like is desired in stacks of foil articles or whenever the punching of waste bundles from stacks of foil blanks is desired and the region from which the waste bundle is punched is to remain peripherally closed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
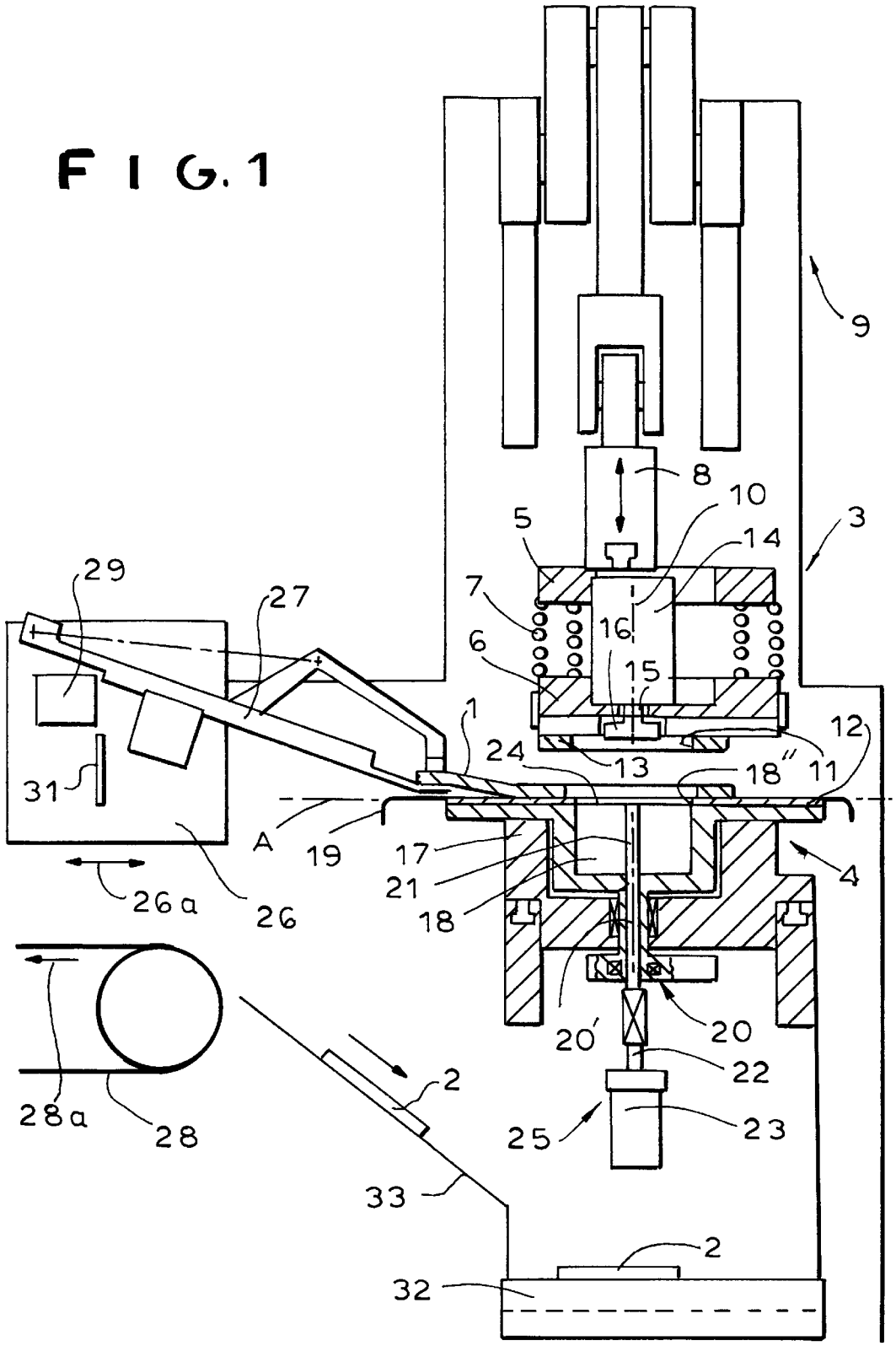
FIG. 1 is a vertical cross sectional view in highly diagrammatic form of the apparatus of the invention as used for producing tie bags.
Figure 2:
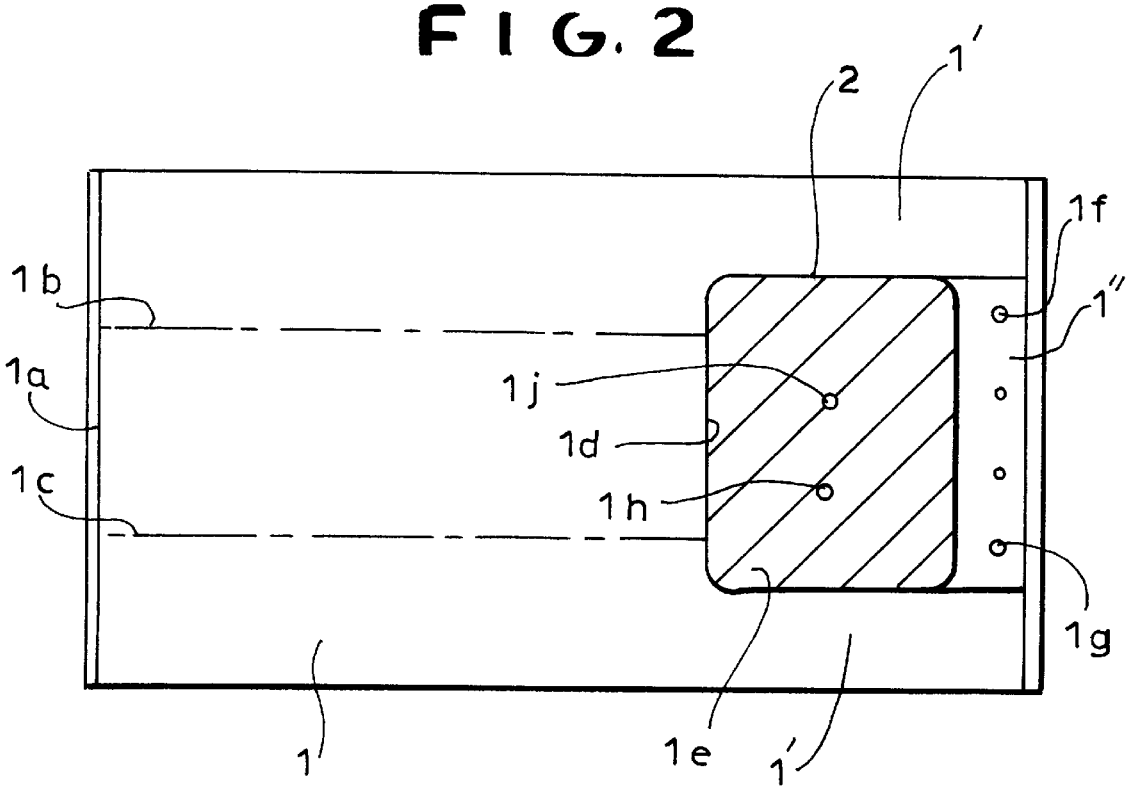
FIG. 2 is a plan view of a tie bag drawn to a greatly reduced scale.
Figure 6:
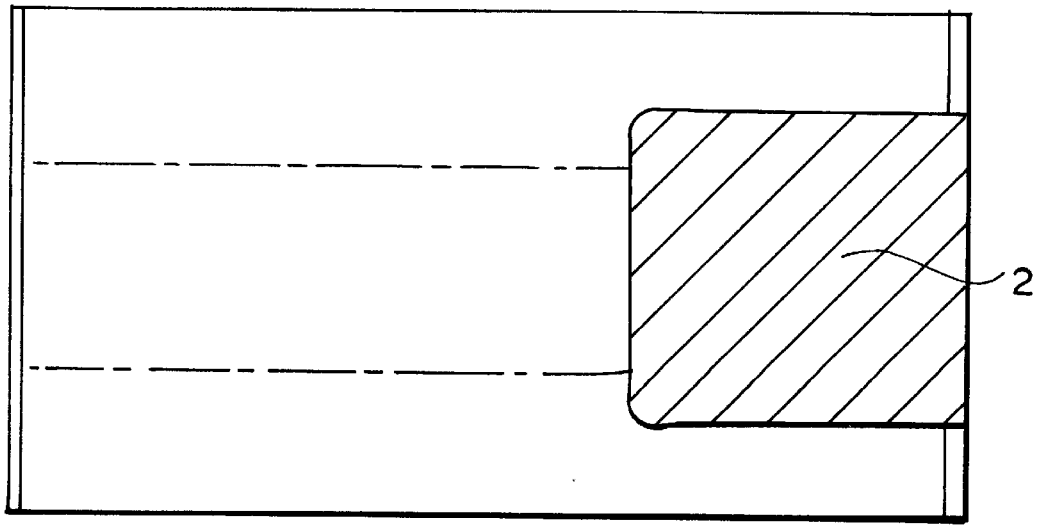
FIG. 6 is a view similar to FIG. 2 of a shirt bag in a reduced scale.
Figure 3:
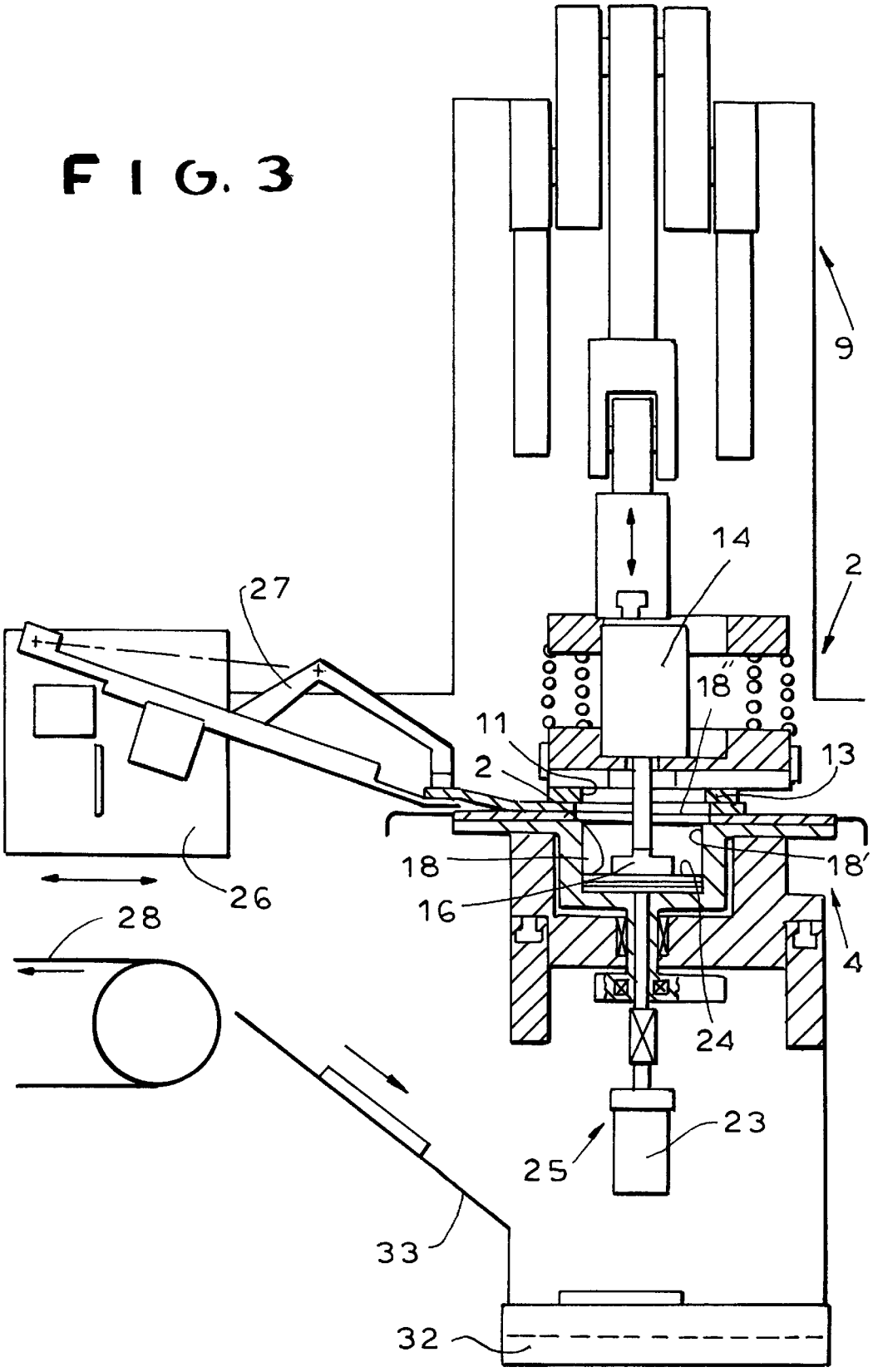
FIG. 3 is a view of the apparatus of FIG. 1 showing positions of the parts thereof directly after a stamping operation.
Figure 4:
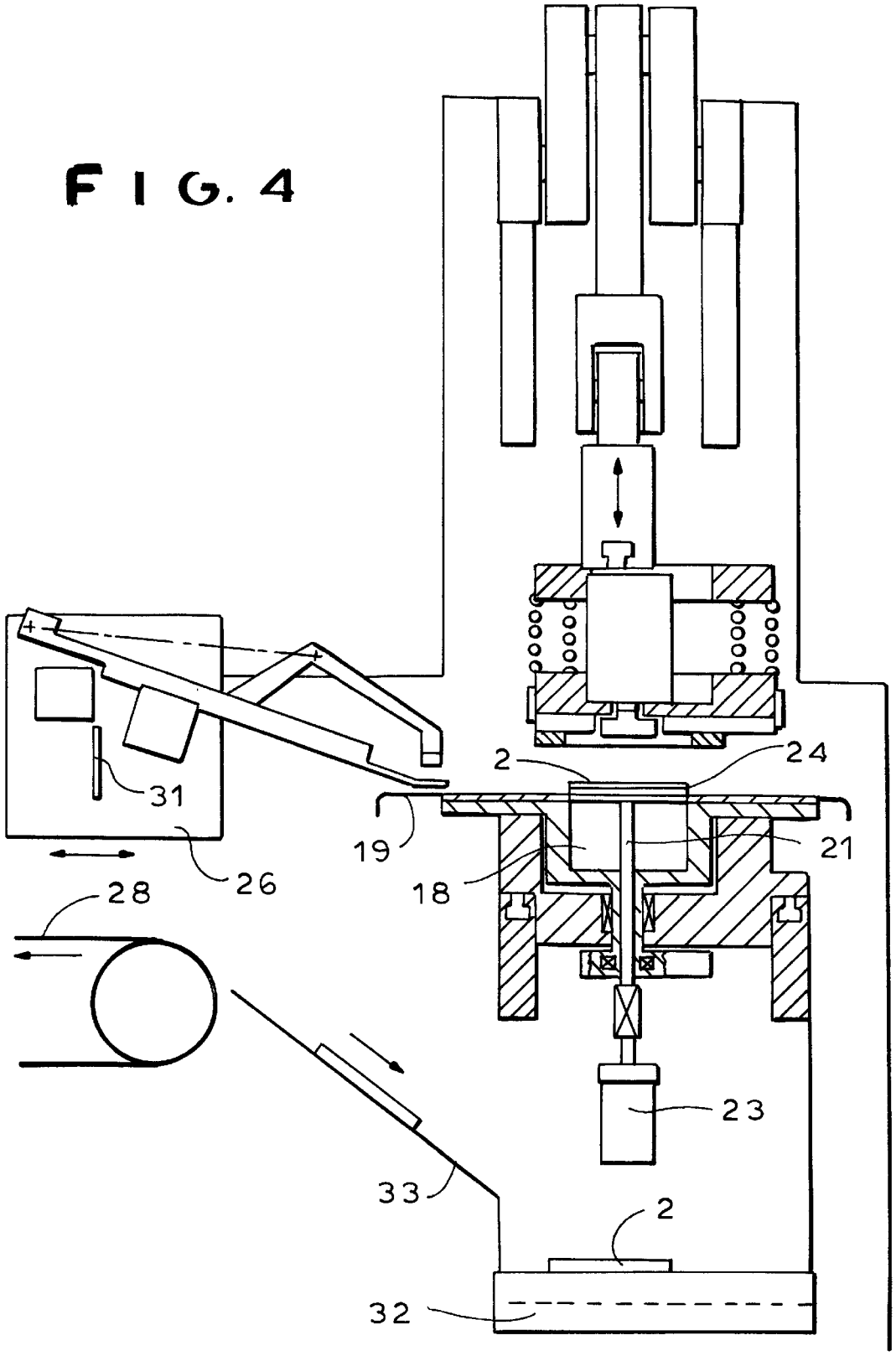
FIG. 4 is a view of the apparatus of FIG. 1 showing the previously punched-out waste bundle at the level of the punching plane to enable it to be removed from the region between the punching blade and the punching plate.
Figure 4A:
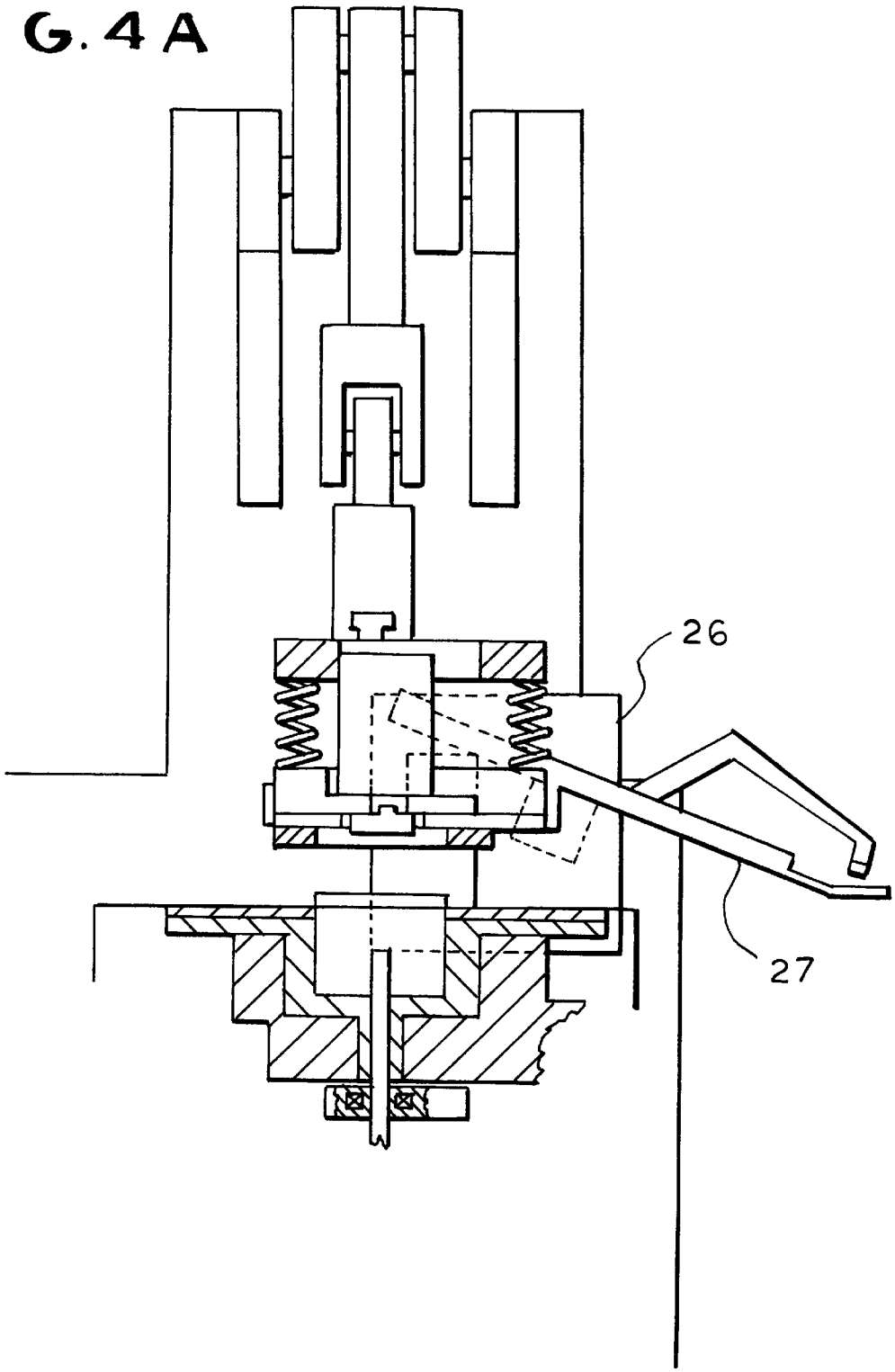
FIG. 4A is a cross sectional view showing the device for removing this bundle about to be displaced across this plane to sweep the punched-out bundle from the punching press and draw another stack of bags into the punching press.

The apparatus of the drawing can be used to produce either a tie bag of the type shown in FIG. 2 or a shirt bag of the type shown in FIG. 6. The tie bag 1 of FIG. 2 has a bottom 1*a* which is sealed and a pair of inwardly folded gussets 1*b* and 1*c* which allow the bag to spread open and to provide an open mouth at 1*d* which is the boundary of a peripherally-closed opening 1*e* from which a waste bundle 2 can be punched when the bags are stacked and the apparatus of FIGS. 1, 3, 4 and 4A is used.

Along the opposite sides of this opening, tie strips 1' are provided and these strips can be connected by a bridge piece 1" which can form, in effect, a pad which has spot welds or the like fusing the bridge pieces of the entire stack of bags together and which is provided with holes 1*f* and 1*g* enabling the stack to be mounted on the prongs of a holder. The bags are pulled from the stack and filled. The apparatus of the invention can punch the peripherally-stacked hole 1*e* in the stack and discharge the resulting waste bundle 2 from the apparatus.

The waste bundle 2 has been shown with hatching in FIG. 2 and it can be seen from this Figure that the waste bundle is surrounded on all sides, i.e. is punched from a peripherally-closed hole. From FIG. 2 it will also be apparent that there are usually spot welds 1*h* and 1*j* joining the layers of the waste bundle 2 together so that the waste bundle is in effect a block of foil layers.

The punching of the waste bundle 2 from the stack of bags is effected with the aid of a punch having at least one upwardly and downwardly movable tool. In the embodiment of the apparatus shown, the punch comprises an upper punching tool 3 and a lower punching tool 4. The upper punching tool 3 has an upper support plate 5 and a lower holding plate 6, between which a spring assembly 7 is located. On the upper support plate 5 there is provided a transverse beam 8 which can be raised and lowered via, for example, a crank drive. The lower holding plate 6 is provided with a peripheral closed cutting blade 11 shaped to stamp out the waste bundle from a stack of the plastic foil bags which can be supported on a cutting plate 12 when the blade 11 is pressed thereagainst by the crank drive 9 and compression of the springs 7. In the region of the cutting blade 11 there is a clamping element 13, i.e. a frame which surrounds the blade 11 and can press against the stack of bags to allow the blade 11 to cut cleanly through the stack. In addition a piston and cylinder unit 14 is provided to act as a pressing element which is capable of pressing centrally upon the waste bundle 2 to press that waste bundle into a recess below the cutting plate 12 as will be described in greater detail below. The pressing unit 14 has a piston rod 15 acting upon a pressure plate which is also described in greater detail below.

The lower punching tool 4 of the device has a cutting plate 12, mentioned earlier, overlying a cutting table 17 juxtaposed with the upper stamping tool 3. The cutting plate 12 may be composed of hard rubber and is formed with a central opening 18' of substantially the shape of the waste bundle 2 and further has on opposite sides sheet metal edge elements 19 which project beyond the table 17 and form additional supports for a stack of bags to be laid on the table 17. Aligned with the opening 19" is a recess 18 in the cutting table 17 which receives the waste bundle 2 once the latter has been punched from the stack of bags. Substantially vertically beneath the axis 10 of the piston and cylinder unit 14, the apparatus is provided with a ram 21 which is connected with a piston rod 22 of a piston and cylinder unit 23. The ram 21 forms together with a lifting plate 24, an ejection element 25 capable of lifting the waste bundle bag into the punching plane. Via the plate 24, therefore, the waste bundle 2, once it has been depressed into the recess following the punching operation, can be lifted into the punching plane in the operational sequence to be described in greater detail below.

In the region of the ram 21 of the ejector element 25, a rotary drive 20 is provided for the cutting table 17 so that the latter can form a turntable to enable orientation of the stack of bags thereon. The rotary drive 20 can comprise a sleeve 20' that is traversed by and guides the ram 21.

In addition, the apparatus comprises approximately at the level of the horizontal stamping or punching plane A, a gripper carriage 26 which is movable back and forth as represented by the arrow 26*a* horizontally parallel to this plane. The gripper carriage 26 carries gripper tongs 27 which can be opened and closed to disengage and engage a stack of bags. The stack can be drawn by the gripper tongs 27 from a supply on the right hand side of the machine, this supply having not been shown. The tongs can engage a stack of such bags, draw the stack onto the cutting plate 12, remove the punched stack from the cutting plate 12 onto a transport belt which carries the stack away in the direction of the arrow 28*a* (FIG. 1) and can repeat the cycle in timed relationship to the opening and closing of the punching press.

The gripper carriage 26 also has a support beam 29 on which a brush 31 is provided. This brush, as described in greater detail below, serves to sweep the waste bundle or block 2, when it is positioned on the stamping plane A, onto a chute 33 from which the waste block can be displaced via a conveyor 32 in a direction perpendicular to the plane of the paper in FIG. 1.

The apparatus shown in FIGS. 1, 3, 4 and 4A operates substantially as follows:

For the punching of the waste bundle 2 from a stack of bags, a stack of bags is drawn by the gripper tongs 27 upon movement of the gripper carriage 26 from its right-hand extreme position (FIG. 4A) to the left so that the stack of bags is transferred from, for example, the welding unit, into the punching press and into the punching position as shown in FIG. 1. For the punching out of the waste bundle 2, as will be apparent from FIG. 3, the upper tool 4 is driven downwardly by the crank drive 9 until the clamp 13 engages the upper side of the stack of bags. The stack of bags is thus securely held.

With further downward movement of the plate 5 and hence of the punching tool 3, the blade 11 cuts out the block 2 while the stack of bags is held by the clamping element 13 so that a clean cut is ensured. After the punching operation, the punched out waste bundle 2 is pressed by the plate 16 of the piston and cylinder unit 14 downwardly into the recess 18 in the cutting table 17.

The side walls 18' of the recess guide the waste bundle 2 downwardly toward the bottom of the recess. As will be apparent from FIG. 3, the ejector element 25 is in its lowered position and only rises once the upper stamping tool 3 has moved upwardly to release the stock of bags. The stack of bags is then drawn by the gripper 27 to the left with concurrent movement of the carriage 26 in this direction to deposit the stack of bags on the conveyor belt 28.

The pressure plate 16 is retracted upwardly until its underside lies above the upper side of the stack of bags.

The gripper carriage 26 again travels to the right to pick up another stack of bags from the welding unit. The cylinder and piston unit 23 is actuated and the ejector plate 26 lifts the waste bundle 2 thereon to a position at or above the punching plane A (see FIGS. 4 and 4A). A new cycle then commences, i.e. the gripper carriage moves to the left to draw the stack of bags onto the punch press while the brush 31 on the gripper carriage sweeps the waste bundle 2 onto the chute 33 so that this chute can deliver the waste bundle to the conveyor 32.

Figure 5:
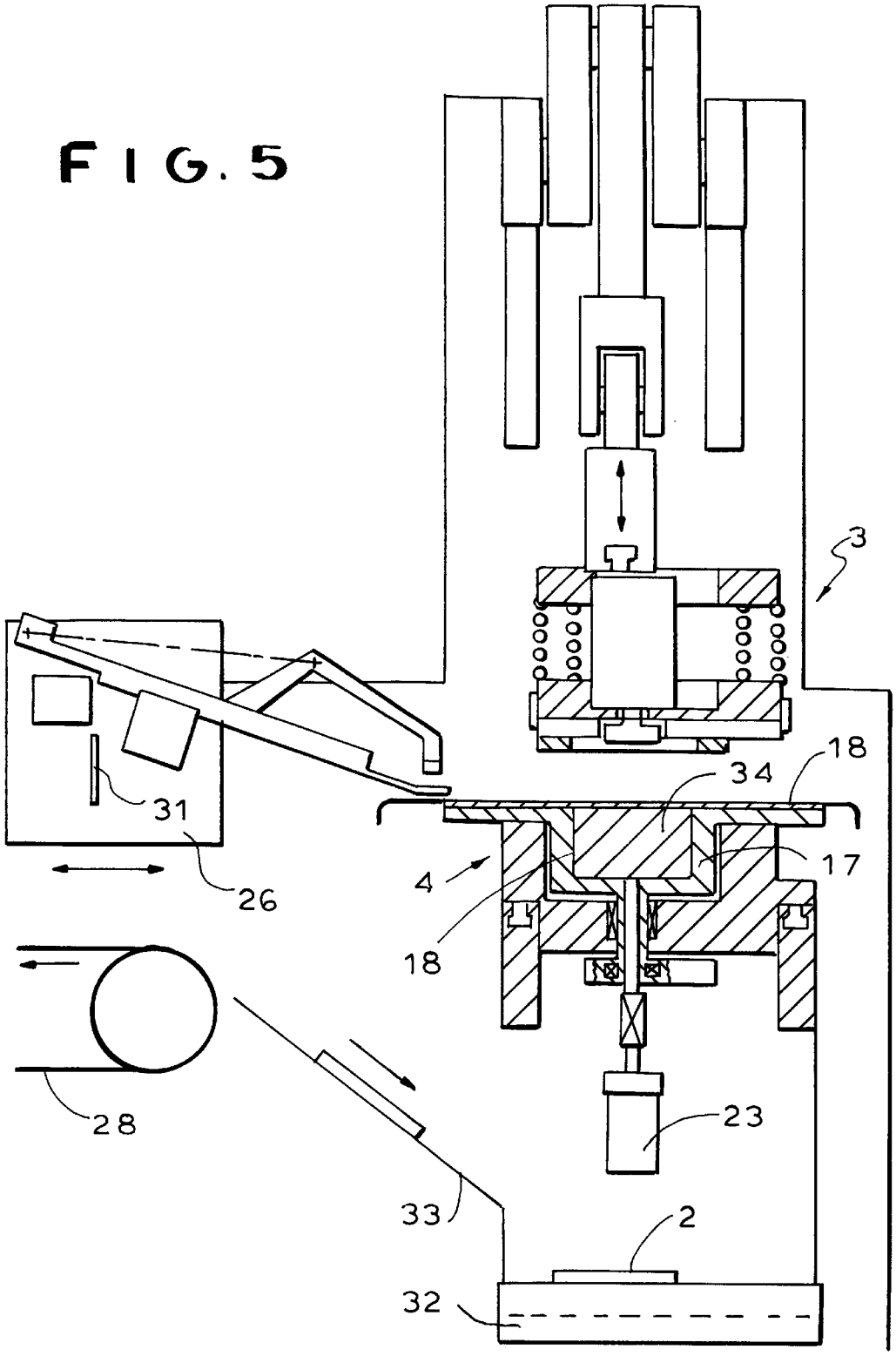
FIG. 5 is a view similar to FIG. 1 but illustrating the apparatus for complete punching, i.e. the punching of a waste bundle to the edge of the stack, i.e. in the production of shirt bags, as contrasted with the punching of a peripherally-closed hole in the stack.

FIG. 5 shows the same apparatus wherein, however, a filler piece 34 has been inserted into the recess 18 in the table 17. This apparatus is used for making so-called shirt bags, i.e. bags in which the waste bundle is cut out to the edge of the stack as shown in FIG. 6 or the waste bundle 2. With such bags a complete punching is carried out to form a U-shaped cut out separating the two handles. In this case, since the bags and the waste bundle 2 can easily be separated as the stack of punched bags is drawn onto the conveyor 28, leaving the waste bundle in the cutting plane so that it can be swept by the brush 31 onto the chute 32, no ejector or recess to receive the waste bundle is necessary. The piston and cylinder unit 23 is thus out of operation in this system which otherwise operates in the manner described in connection with FIG. 1, 3, 4 and 4A.

I claim:

1. An apparatus for punching a waste bundle from a stack of bags, comprising:

a machine frame;

a support on said machine frame;

a cutting plate on said support formed with an upwardly open recess;

a punching member above said cutting plate and movable up and down on said machine frame;

a cutting blade on said punching member aligned with said recess for cutting a waste bundle from a stack of bags overlying said cutting plate and lying in a punching plane;

a pressing element on said punching member for pressing said waste bundle into said recess;

stack-transfer means movable parallel to said punching plane for engagement with a stack of bags, drawing said stack onto said cutting plate, and displacing a stack of bags on said cutting plate after punching away from the cutting plate;

ejection means displaceable in said recess for lifting said waste bundle into said plane; and means on said stack-transfer means engageable with said waste bundle in said plane for displacing said waste bundle away from said cutting plate.

2. The apparatus defined in claim 1 wherein said pressing element includes a piston and cylinder unit and a pressing plate displaced by said piston and cylinder unit for pressing said waste bundle into said recess.

3. The apparatus defined in claim 2 wherein said piston and cylinder unit and said pressing plate have a center line coinciding with the center of said waste bundle.

4. The apparatus defined in claim 1, further comprising a clamping element of rubber on said punching member in the region of said cutting blade for holding said stack against movement by said cutting blade.

5. The apparatus defined in claim 1 wherein said ejection means includes a piston and cylinder unit.

6. The apparatus defined in claim 5 wherein said piston and cylinder unit has a piston rod provided with a ram, an ejection plate at an end of said ram, said piston rod being disposed vertically below an axis of said pressing element.

7. The apparatus defined in claim 6 wherein said ejection plate is guided on said walls of said recess in said cutting plate.

8. The apparatus defined in claim 6 wherein said ram is guided in a rotatable sleeve connecting said cutting table to a drive.

9. The apparatus defined in claim 1, further comprising a chute for delivering waste bundles to a conveyor belt.

10. The apparatus defined in claim 9 wherein said stack-transfer means is a gripper carriage provided with gripper tongs for engaging a stack of bags and drawing said stack of bags onto said cutting plate, and with a brush for sweeping said waste bundle onto said chute.

11. The apparatus defined in claim 1, further comprising a filler piece receivable in said recess for punching a stack of bags in a formation of shirt bags.

* * * * *